US009044052B2

(12) United States Patent
Wong

(10) Patent No.: US 9,044,052 B2
(45) Date of Patent: Jun. 2, 2015

(54) UNITARY GARMENT

(76) Inventor: Lavinia Wong, Winterville, NC (US)

( * ) Notice: Subject to any disclaimer, the term of this patent is extended or adjusted under 35 U.S.C. 154(b) by 314 days.

(21) Appl. No.: 13/492,563

(22) Filed: Jun. 8, 2012

(65) Prior Publication Data

US 2013/0326786 A1 Dec. 12, 2013

(51) Int. Cl.
*A41F 9/00* (2006.01)
*A41D 1/22* (2006.01)

(52) U.S. Cl.
CPC ..... *A41D 1/22* (2013.01); *A41D 2400/44* (2013.01)

(58) Field of Classification Search
CPC ..... A41B 1/06; A41B 9/08; A41B 13/08; A41D 11/00; A41D 31/0005; A41D 1/22; A41D 2400/44
USPC ..... 2/70, 71, 72, 73, 75, 76, 79, 78.2, 80, 2/111, 408, 229, 235, 236, 237, 400
See application file for complete search history.

(56) References Cited

U.S. PATENT DOCUMENTS

| | | | | | |
|---|---|---|---|---|---|
| 679,572 | A | * | 7/1901 | Pennington | 2/78.2 |
| 816,367 | A | * | 3/1906 | Pearson | 2/80 |
| 886,735 | A | * | 5/1908 | Sprague | 2/80 |
| 1,202,578 | A | * | 10/1916 | Peterson | 2/78.2 |
| 1,587,099 | A | | 6/1926 | Williams | |
| 1,742,399 | A | * | 1/1930 | Klein | 602/70 |
| 1,785,581 | A | | 12/1930 | Fellroth | |
| 1,799,336 | A | * | 4/1931 | Walser | 2/71 |
| 1,871,086 | A | * | 8/1932 | Rutledge | 2/78.2 |
| 1,996,536 | A | * | 4/1935 | Berger | 2/78.2 |
| 2,039,946 | A | * | 5/1936 | Wolf et al. | 2/78.2 |
| 2,064,266 | A | * | 12/1936 | Murphey | 2/237 |
| 2,093,902 | A | * | 9/1937 | Bernstein | 2/78.2 |
| 2,093,903 | A | * | 9/1937 | Bernstein | 2/83 |
| 2,485,268 | A | * | 10/1949 | Eschelbacher | 2/78.2 |
| 2,849,717 | A | | 9/1958 | Klotz | |
| 3,041,625 | A | * | 7/1962 | Joseph | 2/80 |
| 3,068,488 | A | * | 12/1962 | Rodriguez | 2/212 |
| 3,088,116 | A | * | 5/1963 | Simonoff | 2/77 |
| 3,712,308 | A | * | 1/1973 | Herbener | 450/95 |
| 3,777,764 | A | * | 12/1973 | Herbener | 450/95 |
| 3,949,427 | A | * | 4/1976 | Sampey | 2/79 |
| 3,956,774 | A | | 5/1976 | Spaulding | |
| 3,994,026 | A | | 11/1976 | Sampey | |
| 4,447,911 | A | | 5/1984 | Marcellaro | |
| 4,457,025 | A | | 7/1984 | Meryash | |
| 4,607,396 | A | | 8/1986 | Craig | |
| 4,941,209 | A | * | 7/1990 | George | 2/79 |
| 5,014,356 | A | | 5/1991 | Tomasi-Dubois | |
| 5,042,092 | A | * | 8/1991 | Ewing | 2/400 |
| 5,060,315 | A | * | 10/1991 | Ewing | 2/69 |
| 5,163,182 | A | | 11/1992 | Fiveash | |
| 5,283,908 | A | * | 2/1994 | Martin | 2/69 |

(Continued)

*Primary Examiner* — Alissa L Hoey
(74) *Attorney, Agent, or Firm* — Thomas A. Beck

(57) ABSTRACT

The invention generally relates to a unitary garment comprising a top bodice element having an elastic waistband, secured to a bottom trouser element having an elastic waistband. The two separate waistbands extend around the lower periphery of the top bodice element, and the other waistband extending around the upper periphery of the bottom element. The waistbands are aligned, contiguously front to back with respect to each other and are secured to each other in their contiguous state by any suitable means. The top bodice element contains means in the front or the back of the garment to allow the wearer an open through which to don the garment and it has excess fabric material neck to waist to provide a blouson effect.

19 Claims, 4 Drawing Sheets

(56) References Cited

U.S. PATENT DOCUMENTS

| | | | | | |
|---|---|---|---|---|---|
| 5,473,780 | A * | 12/1995 | Zen | 2/79 |
| 5,876,395 | A * | 3/1999 | Hart et al. | 604/393 |
| 5,896,581 | A | 4/1999 | Wong | |
| 6,058,514 | A * | 5/2000 | Hart | 2/406 |
| 6,944,883 | B1 * | 9/2005 | Cuaz | 2/69 |
| 7,685,652 | B2 * | 3/2010 | Digney | 2/406 |
| 7,716,753 | B2 * | 5/2010 | Franko | 2/406 |
| 2004/0194193 | A1 * | 10/2004 | Hart | 2/400 |
| 2011/0004982 | A1 * | 1/2011 | Henningsen et al. | 2/458 |
| 2011/0219512 | A1 * | 9/2011 | Davis | 2/79 |

* cited by examiner

UNITARY GARMENT

BACKGROUND

1. Field of Invention

The invention relates to an article of clothing comprising a bodice secured to pants at the front of the waist resulting in a one-piece article of clothing. The rear of the pants possesses an improved substitute for a drop-seat which facilitates addressing toilet and personal hygiene needs.

2. Description of Prior Art

One-piece unitary garments originated as long underwear in the mid 1800's as an alternative to the restricting garments worn by women during that era, and soon gained popularity among men as well. A later progeny of the original type of long underwear was patented in 1868 and was referred to as a "union suit." It was developed as a garment to be worn under exterior clothing in cold climates, and, because it covered all of the arms, torso—both front and back, and legs, it was worn exclusively as long-underwear. It buttoned up the front, was fastened through buttonholes extending from the neck to the groin and had a "drop seat" (i.e., a button-up flap in the rear covering the posterior of the pelvic region in humans, i.e. the buttocks) allowing the wearer to eliminate bodily waste without removing the garment. The "drop seat, being a loose flap at the rear of the garment is often referred to as a "lappet."

Variations and improvements on long-underwear, which, at the time, was worn exclusively as an interior garment, eventuated into a "jumpsuit," so named in about 1944 as it was a full length protective outer garment usually zipped up the front worn by paratroopers for protection when jumping from aircraft.

The jumpsuit morphed into coveralls also worn as an outer garment by mechanics, maintenance personnel, etc.

In the 1960's with the emergence of the "unisex" look, designers saw the benefit of a unitary garment as a different approach to fashion and made the jumpsuit into sportswear which became a chic option for day or evening ladieswear.

With the acceptance of the jumpsuit, (some referred to it as a "Pantsuit") as part of a ladies sportswear wardrobe, many diverse designs have entered the market. The jump suit, like the long-underwear, comprises a one-piece garment. However since the jumpsuit worn in the ordinary course of day or night time activities is designed as "outerwear," it does not, for appearance sake and other obvious reasons, contain the drop seat as found in the union suit.

The reality in wearing a unitary garment is that at some point in time, the wearer will have to respond to a requirement to relieve oneself, or for some hygienic reason. In the past, since long underwear was an inner garment, this was easily accomplished in most instances through the use of the drop seat. If there was no dropseat, e.g., in a coverall, the wearer would be put to the task of removing the outer garments in the confines of a stall or a bathroom, before undertaking the task at hand. This was time-consuming, laborious and inconvenient.

With the advent of the fashionable jump suit worn to various day and night activities, the designers opted to eliminate the drop seat entirely since a buttoned flap in the rear of an otherwise stylish unitary garment would hardly be considered de rigueur.

Thus, there is a need for a stylish jumpsuit that allows the wearer to attend to and be involved in daily activities, and concurrently have a convenient means for relieving oneself or attending to personal hygiene activities.

A review of applicable prior art patents reveals significant shortcomings in the fit, style, and ease of use of the various drop-seat designs to enable the wearer to engage in toilet and personal hygiene activities.

References to Sampey, U.S. Pat. No. 3,949,427 (Apr. 13, 1976) and U.S. Pat. No. 3,994,026 (Nov. 30, 1976); Spaulding, U.S. Pat. No. 3,956,774 (May 18, 1976); Marcellaro, U.S. Pat. No. 4,447,911 (May 15, 1984); Tomasi-Dubois, U.S. Pat. No. 5,014,356 (May 14, 1991); Fiveash, U.S. Pat. No. 5,163,182 (Nov. 17, 1992) have all addressed drop-seat applications adapted to jumpsuits. Applicant's U.S. Pat. No. 5,896,581 (Apr. 27, 1999) relating to a jumpsuit is incorporated by reference herein.

The drop-seat embodiment in these prior designs disclosed in the aforementioned patents suffered from the following limitations:

the drop-seat panel, or lappet, did not closely conform to contours of the body;

the lappet was easily discernible, drawing undesirable attention to the basic toilet function of elimination, the methods for securing the lappet tended to be cumbersome when partially disrobing in toilet facilities, the risk of inadvertently wetting or soiling the garment remained an ever-present possibility.

SUMMARY OF THE INVENTION

The invention generally relates to a unitary garment comprising a top element secured to a bottom element at the waist by means of a waistband. The term "waistband" refers collectively to two separate waistbands. One of the waistbands is hemmed and extends around the lower periphery of the top element, a bodice, and the other waistband extends around the upper periphery (i.e., the waistline) of the bottom element (trousers or pants). Each of these waistbands is elasticized. They are aligned contiguously front to back with respect to each other and are secured to each other in their contiguous state by any suitable means in the front of the garment.

The top element of the present invention is a bodice entity which extends between the neckline and the waist. A bodice, historically, is an article of clothing for women, covering the body from the neck to the waist. In the present invention, the term "bodice" refers to the upper portion of a unitary garment to distinguish it from the trousers and the sleeves. The bodice terminates at the waist or hips with a covered elastic band which surrounds the waistline of the wearer. The bodice of the present invention contains from between about 23% to 33% additional material added to its length so that the covered elastic band of the bodice at full extension extends that much further below the waist or hip of the wearer. The amount of additional material will depend upon the particular style envisioned by the creative designer, as well as the size of the wearer. The covered elastic band fits snugly around the waist or hips of the wearer. The additional length of material forming the bodice from the neck line to the waist in both the front and rear, results in "blousing" about the covered elastic band thereby providing a blouson effect.

The bottom element of the unitary garment of the present invention is a trousers entity or "pants;" however, the bottom element as intended herein includes any garment that covers the lower torso and some or all of the legs, including but not limited to trousers, culottes, shorts, tights with stirrups, etc.

The trousers also have a covered elasticized pants waistband at the top thereof which is positioned circumferentially at and around the waist of the wearer. The trousers' covered elasticized pants waistband is secured at two separate locations along the horizontal plane in contiguous front to back alignment with the covered elastic band of the bodice, thus resulting the two separate elements forming in a unitary garment with the bodice secured to the trousers. The covered elastic band and the covered elastic pants waistband are able to be separated from each other at the sides and rear of the garment. The covered elastic band at the lower portion of the bodice and the covered elastic pants waistband are not able to be separated from each other in the front of the garment between the two separate locations where the respective waistbands are secured to each other.

With respect to the contiguous front to back alignment of the waistbands, either the covered elastic band of the bodice or the covered elasticized pants waistband of the trousers can occupy the front, with the other positioned contiguously in the back.

The unitary garment of the present invention distinguishes over the prior art by virtue of its improved drop seat features enabling the wearer of such one piece garment which provides quick and easy access to facilities to relieve oneself and for hygiene purposes, if necessary, while substantially concealing that the garment possesses a drop seat alternative.

As noted above, because the covered elastic band of the bodice is secured to the covered elastic pants waistband in the front of the garment, (or the opposite, as noted above), the two waistbands at the sides and/or rear of the garment, can be moved independently of each other. This feature, along with the blousing of the bodice at the waistbands provides a unique improvement to the jumpsuits found in the prior art.

A first embodiment of the present invention eliminates the dropseat entirely. The dropseat can be eliminated as a result of the material used to make the garment.

In accordance with the first embodiment, the unitary garment is made from a flexible elastic material. The materials used can be natural or synthetic latex or a synthetic polymer.

The synthetic polymer used is formed into a material referred to as a "Stretch Fabric." Stretch Fabric is a term that refers to synthetic fabrics which stretch. A preferred material to be used in accordance with the present invention is spandex or elastane, (a polyurethane-polyurea copolymer made according to the well-known dry-spinning process), a synthetic fiber known for its exceptional elasticity. One brand name, among others, for spandex is Lycra®.

Other synthetic materials suitable for use in fabricating the garment in accordance with the present invention can be used so long as it stretches in at least two directions. For example, polyester can be knitted into fabrics that will stretch. Polyester can be blended with other materials and fabricated into fabrics that will stretch.

When the garment is made from any of the elastic flexible materials discussed above, the wearer, upon need to relieve oneself, merely needs to grasp the pants' waistband on the outside of the two bartacked sites and lower the pants to achieve the requisite state for carrying out the intended purpose. The "requisite state" can be achieved in such case because when the waistbands are grasped and pulled downward, the extra fabric extending the vertical length of the bodice, which provides the blousing effect around the covered elastic band, is concurrently lowered vertically the additional inches provided by the blousing effect, and rendering the fabric comprising the bodice fitted to the wearer and substantially taut. With the bodice fully lowered, the wearer continues to lower the rear of the covered elastic pants waistband exposing an opening between the rear bottom of the bodice and the rear top of the trousers, and continues to move the rear of the pants downward over the buttocks and then slides the top rear of the pants to reach substantially the back of the mid-thigh, thus exposing the buttocks of the wearer. At this point the buttocks are fully exposed to use the toilet. The fact that one is using an elastic, flexible, stretchable material in this embodiment eliminates the need for a drop seat.

A second embodiment of the present invention eliminates the use of the standard quadrilateral drop seat lappet which covers the buttocks of the wearer, the functional purpose of which is readily apparent. Instead, when a non-stretchable fabric material is used to form the garment, closure means, preferably a zipper, is inserted in the center rear of the pants extending vertically downward from the pants rear waistband for a suitable distance down the buttocks, to expose a sufficient portion of the buttocks to complete the intended purpose of lowering same. As is the case with the first embodiment described above, the procedure is identical. The zipper is opened, the blousing effect provides the extra length to the blouse to allow the pants to lower sufficiently (i.e., to rear mid thigh) to fully expose the buttocks, and the requisite state is achieved.

The instant invention enhances the styling line of a unitary outer garment by conforming to the body contours of the buttocks and hip area and concealing the existence of dropseat means. Thus the function of the drop seat lappet of the prior art is achieved using the pants' material only with no additional fabric (lappet) attached thereto.

With respect to the second embodiment, when a covering flap is used in conjunction with the zipper, the presence of a means to relieve oneself is virtually undetectable by the casual observer.

The present invention sustains the basic purpose of the drop seat function to enable seated toilet functions without the necessity of laborious partial disrobing from the unitary outer garment (with the attendant possibility of accidental wetting or soiling of the clothing).

A third embodiment of the present invention is an undergarment to be worn with the unitary garment described above.

In summary, the unitary garment of the present invention has a bodice having a front-side, a back-side, an upper segment and a lower segment having an edge comprising a covered elastic band and trousers having a front-side, a back-side and an upper trouser segment having an upper edge comprising a covered elastic pants waistband. The upper segment of the bodice refers to the top portion of the bodice in alignment with the shoulders, and comprises a neck opening in the garment which provides the means for the wearer to insert his/her head through the opening when donning the garment.

The invention has means securing in contiguous relationship, at least at one location, the covered elastic band of the front-side of said bodice, to the covered elastic pants waistband of the front-side of said trousers, thus forming a unitary garment.

The bodice possesses from between about 23% to about 33% additional material added to its length from a neckline to an original waistline of a wearer so that, around said waistline, there is a blouson effect resulting from said additional material.

When the secured covered elastic band of said bodice and the covered elastic pants waistband of said trousers are simultaneously lowered to fully downwardly extend the material comprising said bodice, the secured covered elastic band of the bodice and the covered elastic pants waistband of the trousers extend a distance below the waistline of the wearer the length of the additional material.

When the additional material of said bodice is fully extended, the covered elastic pants waistband on the backside of the trousers is adapted to be further lowered substantially to rear mid-thigh to expose buttocks of the wearer.

BRIEF DESCRIPTION OF THE DRAWINGS

The invention will now be described in greater detail in the following description of the preferred embodiments taken in conjunction with the accompanying drawings.

DESCRIPTION OF THE PREFERRED EMBODIMENT

In the following detailed description, reference is made to the accompanying drawings that show, by way of illustration, specific embodiments in which the invention may be practiced. These embodiments are described in sufficient detail in the specification and drawings to enable those skilled in the art to practice the invention. It is to be understood that the various embodiments of the invention, although different, are not necessarily mutually exclusive. For example, a particular feature, structure, or characteristic described herein, in connection with one embodiment, may be implemented within other embodiments without departing from the spirit and scope of the invention. In addition, it is to be understood that the location or arrangement of individual elements within each disclosed embodiment may be modified without departing from the spirit and scope of the invention. The following detailed description is, therefore, not to be taken in a limiting sense, and the scope of the present invention is defined only by the appended claims, appropriately interpreted, along with the full range of equivalents to which the claims are entitled.

Figures 1, 2, 2A:
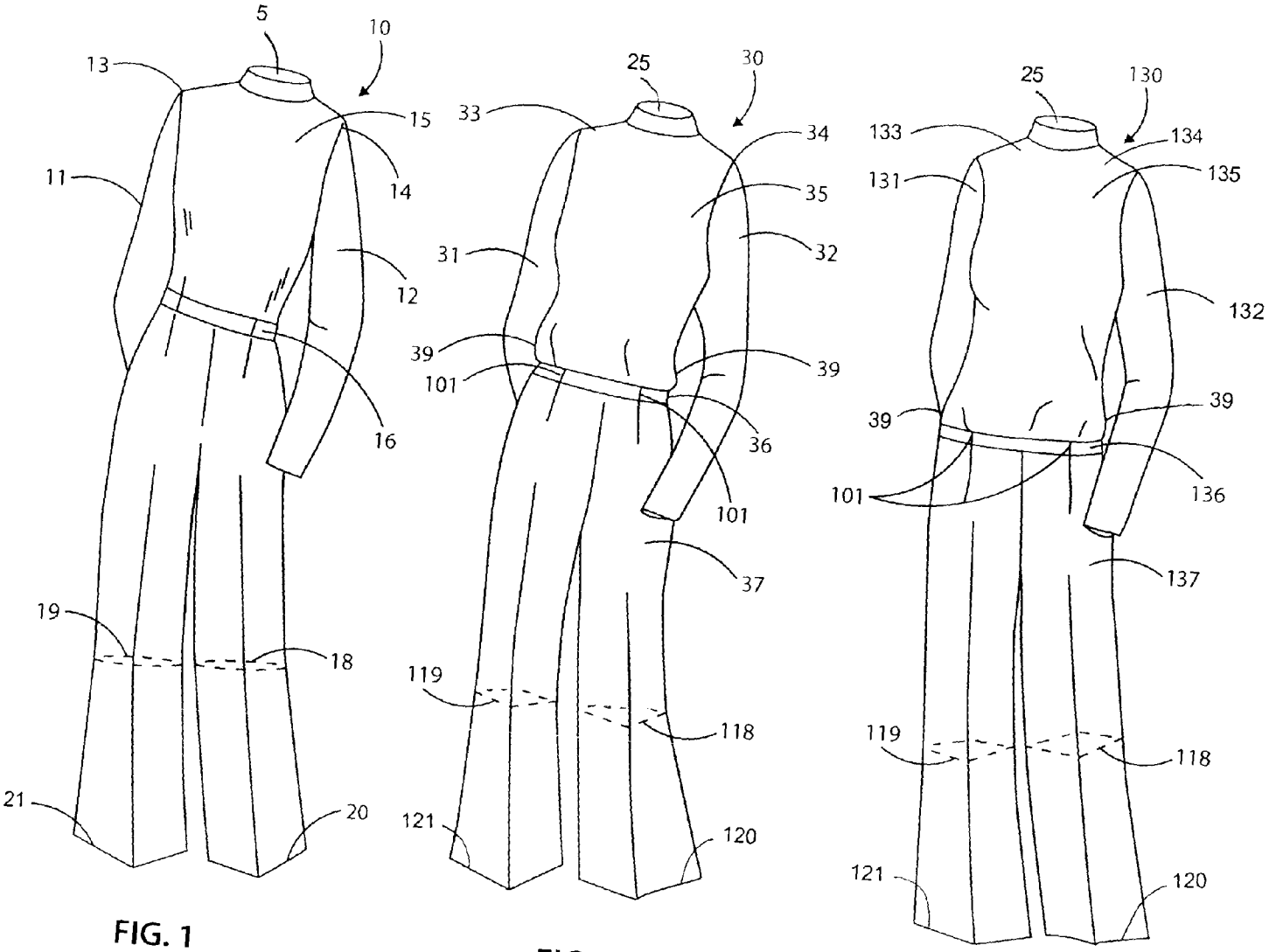
FIG. 1 is a front view of a unitary garment found in the prior art.
FIG. 2 is a front view of the unitary garment falling within the scope of the present invention wherein the waistband is located at the waist of the wearer.
FIG. 2A is a front view of the unitary garment falling within the scope of the present invention wherein the waistband is located at the hips of the wearer.

FIG. 1 depicts a prior art unitary garment, more specifically, a jump suit 10, having neck opening 5, sleeves 11, 12, bodice 15, waistband 16 and trousers 17. Bodice 15 or upper portion of jump suit 10, is the fitted part of the garment that extends from shoulders 13, 14 to waist 16. Bodice in this garment is form fitting, meaning that the material comprising the bodice of the garment perfectly aligns to the shape and contours of the individual wearing same to the waistband. Trousers 17 are shaped to cover the body from waistband 16 to knees 18, or from waist 16 full length to ankles 19.

With respect to the present invention, FIG. 2 depicts unitary garment 30, neck opening 25, shoulders 33 and 34 in alignment at the upper segment of bodice 35, sleeves 31, 32, band 36 and pants/trousers 37. Bodice 35 fits loosely such that there is a blousing effect 39 around the periphery of the lower portion of bodice 35 at covered elastic band waistband 36.

The design of the bodice is an important feature in the present invention. Bodice 35 terminates at its waist at the covered elastic band (waistband) 36, which surrounds the waistline of the wearer.

For purposes of the present invention as depicted in FIG. 2, the waist is located vertically around the mid-section of the wearer's body and extends from the smallest circumference of the natural waist, or, optionally just above and below same. The length of the bodice from neck to waist will vary according to where the waist is located at the normal location, which for the embodiment depicted in FIG. 2 is substantially just above or below the navel, according to the style dictated by the age-group or condition of the person wearing the garment.

The bodice of the present invention is different from other bodices contained in unitary garments, as, by design, the bodice of the present invention purposely contains from between about 23% to about 33% additional material which is added to its length, depending upon the garment size of the wearer and/or where the wearer wants the waist located, so that the covered elastic band of the bodice at full extension (i.e., when lowered or pulled down) extends that much further below the waist of the wearer. The covered elastic band 36 fits snugly around the waist of the wearer. The additional length of material forming the bodice from the neck line to the waist in both the front and rear, results in "blousing" 39 about the waistband when it is situated in its normal position on the wearer, thereby providing the blouson effect 39 referred to above. The additional length of material provides the means to fulfill the objective of the invention as detailed hereinafter. The blouson effect drop is preferably about 24%. The blouson drop on different sizes is graded accordingly when making the different garment sizes.

In the embodiment of the present invention depicted in FIG. 2, extra fabric is added to increase and extend the length of the bodice to provide blousing and easing effect 39 providing a surplus of fabric above the waistband. As used herein in conjunction with the description of the present invention, the verb "blousing" refers to "gathering in and draping over loosely" as is depicted at 39 in FIGS. 2 and 2A and more definitively in FIG. 3.

Pants/trousers 37 can be knee length or full length as desired. If the unitary garment of the present invention is to be knee length with short pants, trouser 37 will extend downward from the waist to cover the lower torso of the body and legs of the wearer from waistband 36 to the knee area 118, 119. If the unitary garment is designed to be full length covering the legs of the wearer, trouser 37 will extend downward from the waist to cover the lower torso of the body and legs of the wearer from waistband 16 to ankle area 120 and 121.

The elements comprising the garment depicted in FIG. 2A are identical to those comprising the garment depicted in FIG. 2, except that the "waistband" is lowered to the vicinity of the hips. FIG. 2A depicts the unitary garment, a jump suit 130, of the neck opening 25, and shoulders 133 and 134 in alignment at the upper segment of bodice 135, sleeves 131, 132, waistband 136 and pants/trousers 137. Bodice 135 fits loosely such that there is an excess of material providing the blousing effect 39 around the periphery of the lower portion of bodice 135 at waistband 136. The covered elastic band 136 of bodice 135 terminates at the hips. For purposes of the embodiment depicted in FIG. 2A of the present invention, covered elastic band 136 surrounds the hips of the wearer and extends down to the hip circumference measured at its widest part of the buttocks or hip. The bodice depicted in FIG. 2A also purposely contains from between about 23% to about 33% additional material which is added to its length.

Also, in the event the waist is convex rather than concave, such as is the case in pregnancy or obesity, the waist may be measured at a horizontal level one inch above the navel. Thus as depicted in FIG. 2 and FIG. 2A, the length of the bodice from neck to waist will vary according to whether the waist is located at the normal location, substantially just above or below the navel, or down to the hip area.

As is the case in the garment embodied in FIG. 2, pants/trousers 37 can likewise be knee length or full length as desired.

FIGS. 2 and 2A do not depict closure means in the front (or the back) of the garment. The closure means, (a zipper, a Velcro® band, etc.) not shown, generally extends downwardly (usually vertically) from the bodice neckline, i.e., the top edge of the garment that surrounds the neck opening. Closure means is preferably incorporated into the garment at the location enumerated above because when the closure means is opened, it provides a sufficiently large opening at the neckline of the bodice of the garment to allow the wearer to don the garment by inserting his or her body, legs first, through the top opening of the garment until legs and torso of the wearing are in place in the garment. While it is preferred to have closure means incorporated into the garment extending downwardly from the neckline, the present invention also includes a garment wherein there is no closure means, provided that the material comprising the garment has has properties wherein the elastic limit of the fabric is not exceeded and the fabric can return to its initial form or state following the deformation which occurs when the wearer dons the garment.

Figure 3:
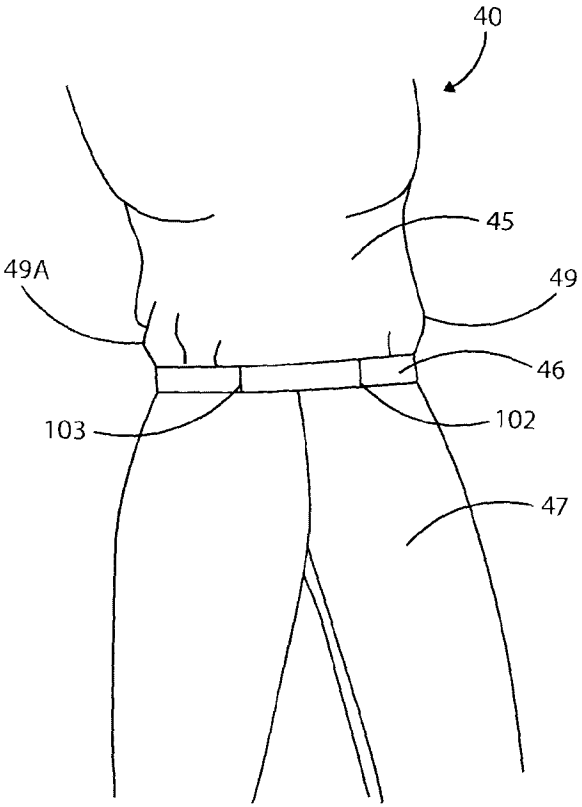
FIG. 3 is a closeup front view of a torso wearing the unitary garment depicted in FIG. 2.

FIG. 3 is an enlarged close-up partial view of the jumpsuit depicted in FIG. 2. The jumpsuit 40 depicted in FIG. 3 has bodice 45, waistband 46 and trousers 47. The front area of bodice 45 is secured to trousers 47 using bartacks 101 which extend through waistband 46. Barracks 102, 103 are positioned horizontally parallel adjacent to each other away from the center of the wearer, each bartack more toward each hip of the wearer. Waistband 46 comprises a covered elastic band in front, and a covered elastic pants waistband, (not shown). While FIG. 3 depicts the covered elastic band in front, if desired the covered elastic pants waistband can optionally be placed in front with the covered elastic band place contiguously behind it. The blousing and easing effect surrounding the periphery of waistband 46 of bodice 45 is shown at 49 and 49A.

Figure 4:
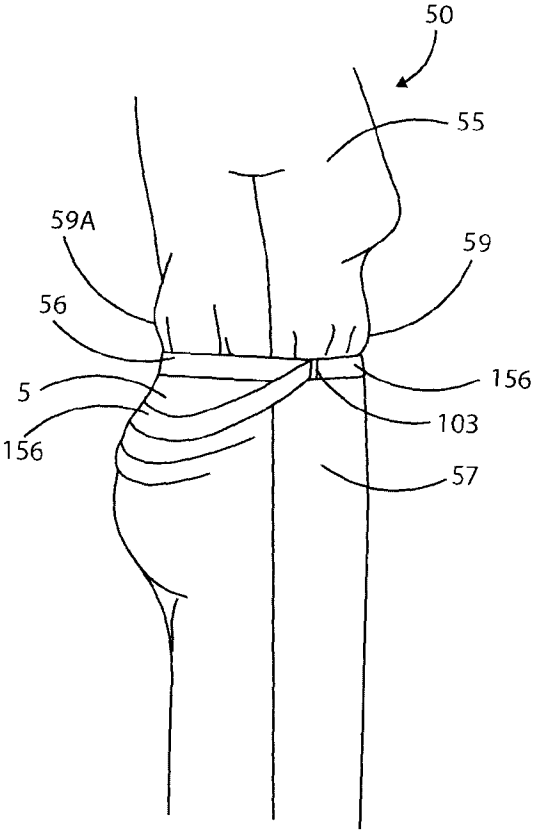
FIG. 4 is a side view of the unitary garment depicted in FIG. 2 with the pants partially lowered.

FIG. 4 depicts a partial side view of the unitary garment 50 of the present invention. FIG. 4 shows bodice 55 with the blouson effect 59, 59A, as described above, around the lower portion of bodice and trousers 57. The waistband depicted in FIG. 4 comprises a a covered elastic pants waistband 156 in front (the outer elastic waistband) and a covered elastic band 56 (the inner elastic waistband).

When the wearer feels compelled to relieve himself/herself, the wearer lowers trousers 57, by grasping at each side of the rear of the garment and pulling covered elastic pants waistband 156 vertically downwardly from a location away from bartack 103 which secures covered elastic pants waistband 156 in front to covered elastic band 56 at the lower extremity of the bodice. Covered elastic band 56 extends around the backside of the wearer at waist level. Because covered elastic pants waistband 156 in front is affixed to covered elastic band 56, the downward pull on covered elastic pants waistband 156 also lowers covered elastic band 56 following the contour of the body. This pulling/lowering action concurrently straightens out the bodice fabric that was bloused around bodice covered elastic band 56 and lowers the horizontal position of the bottom of bodice 55 and the top of trouser 57 with respect to buttock 5. This allows the wearer to expose the entire buttocks as needed. Regardless of which embodiment is used, extending the length of bodice 55 by lowering pants 57 results in the rear portion of trousers 57 to extend to mid-thigh when seated.

FIG. 4 depicts the unitary garment of the present invention with the rear of trousers 57 slightly lowered, but before the bloused fabric of bodice 55 secured to covered elastic band 56 has been lowered to fully extend the fabric to a substantially taut position. When the fabric of the bodice is taut, after being lowered, the bottom of the bodice and the top of the trousers will both be anywhere from 2 to 5 inches lower.

Although FIG. 4 depicts the waistband substantially at the navel level, it is understood that the "waist" can be located at hip level. In event the waist is at hip level of the wearer, the length of the bodice will be that much longer, and there will be an additional between 23% and 33% material added to the length of the bodice to obtain the blouson effect.

Figure 5:
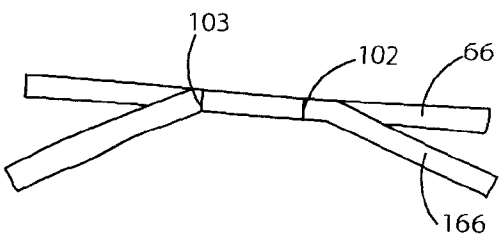
FIG. 5 is a closeup of the waistbands showing their positions with respect to each other when bodice and pants are positioned as depicted in FIG. 4.

FIG. 5 is a front view of the assembled waistbands. As shown, covered elastic pants waistband 166 in front (the outer elastic waistband) and a covered elastic band 66 (the inner elastic waistband) are attached to each other via two bartacks 102, 103.

FIG. 5 shows the positioning of the waistbands 66 and 166 with respect to each other when the arrangement of the two is as shown in FIG. 4. Waistbands 66 and 166 are conveniently joined at two locations 102 and 103 evenly on each side of the center front waist or extending outward from the center to the hip area.

The bar tack fastener elements described secure in overlapping contiguous relationship, at least at one location, the continuous covered bodice elastic waistband of the front-side of the bodice entity, to the continuous covered elastic waistband of the front-side of the trousers entity, thus forming a garment comprising the bodice entity fastened to the trousers entity.

Figure 6A:
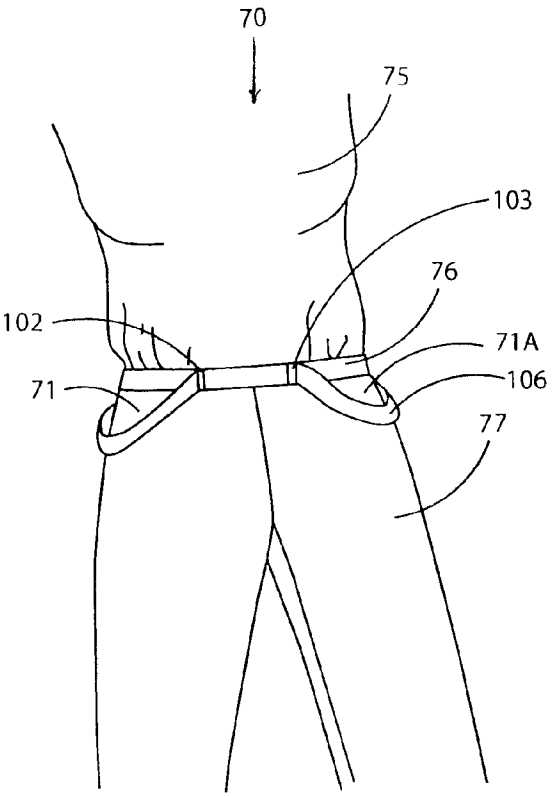
FIG. 6A is a front view of bartacks securing the waistbands showing the positions with respect to each other when bodice and pants are positioned as depicted in FIG. 4.
Figure 6:
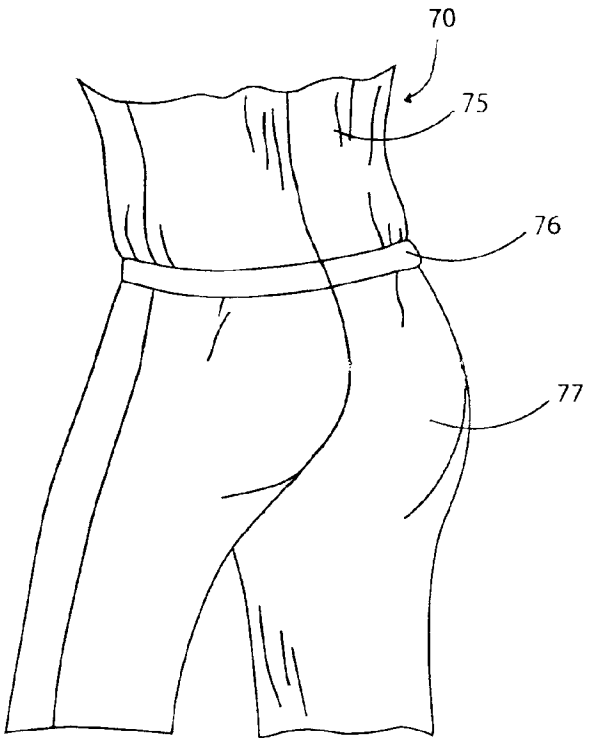
FIG. 6 is a rear view of a unitary garment falling within the scope of the present invention.

FIG. 6 depicts a partial isometric view of the rear of the unitary garment 70 of the present invention. Bodice 75 is attached to trousers 77 in the front of the garment at waistband 76 which surrounds the mid section of garment 70.

FIG. 6A is a partial front view of unitary garment 70 depicted in FIG. 6 of the present invention. Bodice 75, at covered elastic band 76 which surrounds the garment in contact with the waist or hips of the wearer, is attached at bartacks 102 and 103 to trousers 77 at covered elastic pants waistband 106 in the front of garment waistband 76. FIG. 6A depicts the appearance of garment 70 when trouser waistband 106 is in the process of being lowered to expose the wearer's hips or undergarment 71 and 71A and wearer's buttocks (not shown).

Figure 7:
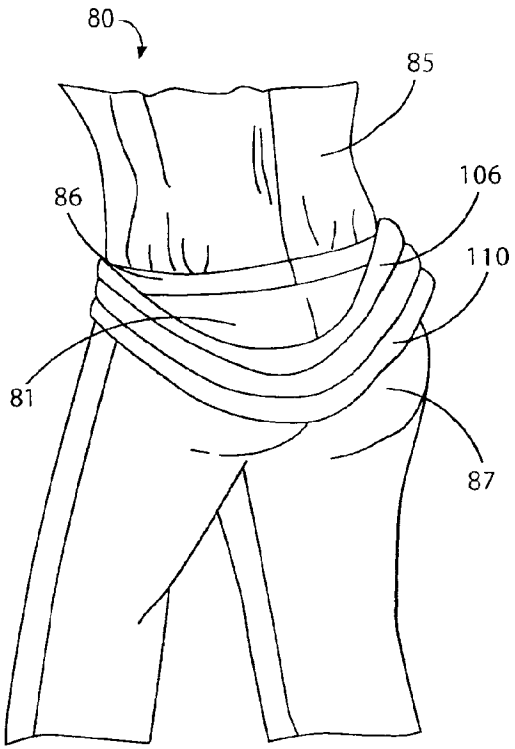
FIG. 7 is a rear view of a first embodiment of the unitary garment depicted in FIG. 4 with the trousers lowered.

FIG. 7 is a partial rear view of the unitary garment depicted in FIG. 6 and FIG. 6A. Garment 80 comprises bodice 85, bodice covered elastic band 86, trousers 87 and trouser covered elastic pants waistband 106. In the view depicted in FIG. 7, the covered elastic band 86 has been pulled down so that the material forming bodice 85 is taut following the body curvature of the wearer and the blouson effect has been eliminated.

The covered elastic pants waistband 106 and accordingly rear of trouser 87 are lowered and the fabric thereof is bunched up to form folds of trouser fabric 110. When rear of trouser 87 is lowered, bare buttocks or undergarment 81 is exposed. As noted above, the embodiment depicted in FIG. 7 is conveniently made of a stretchable material such as Spandex (as defined above) so FIG. 7 shows the stretchable material gathered 110 around the buttocks prior to elastic pants waistband 106 and trouser 87 being lowered.

The embodiment shown in FIGS. 6 and 7 will generally have closure means (not shown) extending downward from the neckline, as enumerated above (as shown in the back of the garment in FIG. 8) in either the front or the back of the garment to allow the wearer to don the garment.

Figure 9:
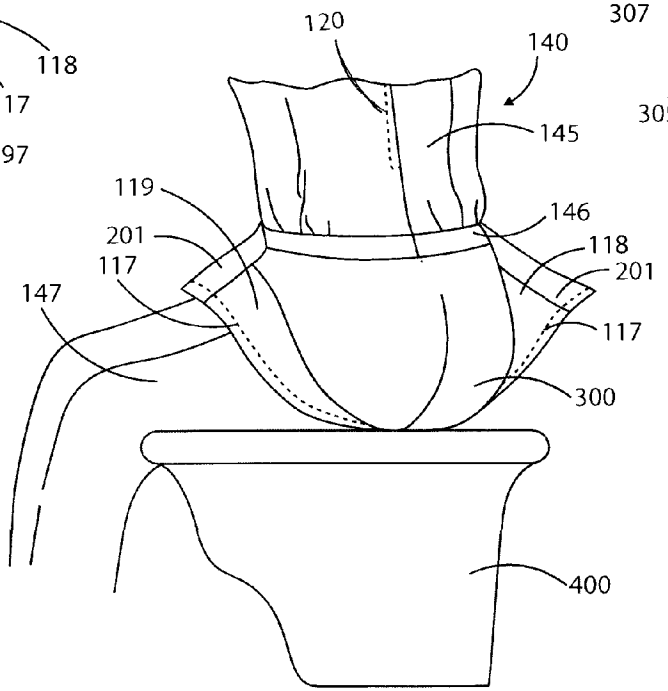
FIG. 9 is a side view of the second embodiment of the unitary garment depicted in FIG. 8 as the trousers appear when the wearer is seated.
Figure 8:
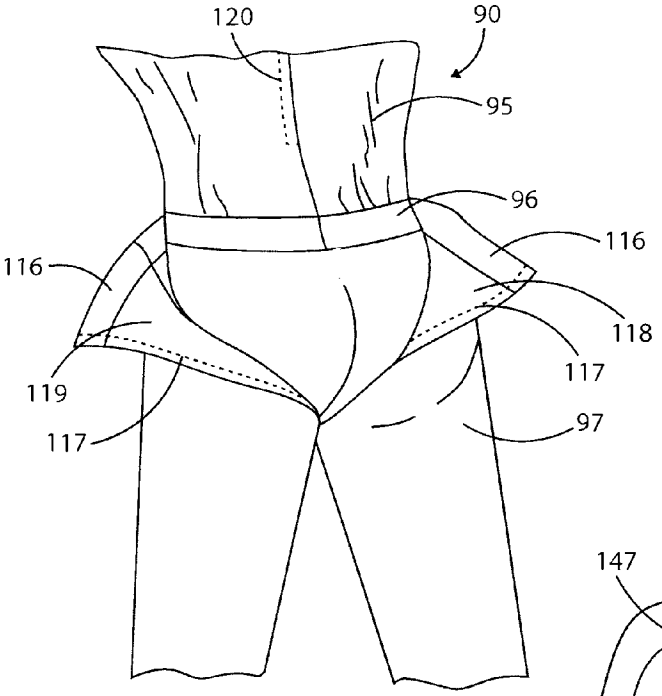
FIG. 8 is a rear view of a second embodiment of the unitary garment depicted in FIG. 4 with the rear of the trousers unzipped.

FIG. 8 is a partial rear view of the unitary garment having closure means in the rear of same. Garment 90 comprises bodice 95, covered elastic band 96, trousers 97 and trouser covered elastic pants waistband 116. In the view depicted in FIG. 8, the covered elastic band 96 has been pulled down so that the material forming bodice 95 is taut following the body curvature of the wearer and the blouson effect has been eliminated. The embodiment depicted is not made of a stretchable material and has closure means, i.e. a zipper 117 (or Velcro® fastener) in the open position which provides flaps 118, 119. Flaps 118, 119 open out the lower portion of the garment so that the rear of the garment can be more easily moved down across the buttocks when the wearer desires to don the garment or desires to expose the buttocks for the purpose of using the commode as depicted in FIG. 9.

A zipper, Velcro® fastener, placket, etc. 120 or other convenient closure means as mentioned hereinabove, is inserted in the back of the bodice down from the neck opening (not shown) extending vertically downward a distance suitable to separate the back of the bodice into two separate flaps, thereby making it easier for the wearer to don the garment by inserting his/her head through the neck opening.

While a zipper, a Velcro® fastener, a placket, etc. (117, 120) can be conveniently used as mentioned above in the back of the garment, other closure means such as loops and buttons, hook and eye, etc. can also be used within the scope of the invention.

When the need arises, the wearer simultaneously pulls down the bodice covered elastic band 96 and the pants trouser covered elastic pants waistband 116 to a distance as far as the bodice fabric will allow. At that point, depending upon which embodiment is present, the wearer will pull the stretchable garment fabric beyond the buttocks area and sit, or will first unzip the zipper in the center portion of the back of the pants to open up the lower portion of the garment and will then pull the garment fabric beyond the buttocks area and sit. The construction of either embodiment serves to preclude the garment from becoming soiled by immersion in the toilet or coming into contact with the surrounding floor area. After accomplishing the necessary toilet and personal hygiene activities the wearer arises and secures the garment in its original position.

FIG. 9 is a partial rear view of unitary garment 140 described in FIG. 8. Garment 140 comprises bodice 145, covered elastic band 146, trousers 147 and trouser covered elastic pants waistband 201. The wearer is seated with buttocks 300 on commode 400 with rear garment flaps 118 and 119 being lowered to mid thighs to allow wearer's buttocks complete unobstructed access to commode 400. FIG. 9 is not drawn accurately to scale as it is included to show the relationship among bodice, trouser and wearer when the garment is lowered to enable the wearer to use the commode. In actual use, the base of zipper 117 will be positioned at or near the back of the wearer's mid-thigh, away from the leading edge of the commode.

Figure 10:
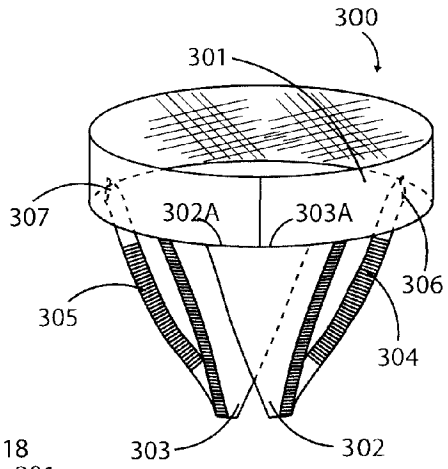
FIG. 10 is an isometric front view of a undergarment used in combination with the unitary garment of the present invention.

FIG. 10 is an undergarment to be worn with the unitary garment of the present invention. The undergarment 300 comprises a waistband 301 an overlapping independent pair of triangular flaps 302, 303 secured along their bases 302A and 302B to the front of waistband 300. Straps 304 and 305 each extend rearwardly from each apex, and are continuations of triangular flaps 302, 303 secured to the interior surface of waistband 301.

As noted above, the unitary garment incorporating the embodiments of the present invention can be worn over the upper and lower torso of a man, woman, or child. It has application for all types of dress, including formal, casual, work, and recreational environments.

The construction illustrated and described in the preferred embodiments, represent a standard fabrication process in the garment industry. Other manifestations are potentially feasible. An aspect of the garment's appeal is concealment of any indicia that it has means for easy toilet access, all the while maintaining a pleasing style line which conforms to body contours and allows easy and trouble-free access to toilet facilities.

The preceding description contains certain specifications which should not be construed as limiting the scope of the invention. A wide variety of embodiments suitable for unitary clothing styles, gender, and ages of intended wearers is possible. Many variations in the manufacturing process can be implemented to incorporate the innovative features of the uniquely improved drop-seat modification for unitary garments. The unitary garment of the present invention is designed to be used by men, women and children as functional dress for sportswear, uniforms, casual wear, sleepwear, leisure lounging wear, hospital wear, evening and dressy cocktail wear. The jumpsuit can be made of any suitable fabric desired, depending upon which embodiment is to be used. For example, the unitary garment can be made from a spandex, jersey, rayon, polyester, nylon, cotton, crepe and denim, etc., alone or a combination thereof.

While all of the fundamental characteristics and features of the present garment of the disclosed invention have been described herein, with reference to particular embodiments thereof, a latitude of modification, various changes and substitutions are intended in the foregoing disclosure and it will be apparent that in some instance, some features of the invention will be employed without a corresponding use of other features without departing from the scope of the invention as set forth. It should be understood that any such substitutions, modifications, and variations may be made by those skilled in the art without departing from the spirit or scope of the invention. Consequently, all such modifications and variations are included within the scope of the invention as defined by the following claims.

What I claim and desire to protect by Letters Patent is:

1. A garment comprising:

a bodice entity, made from a material, said bodice entity having a front-side, a back-side, an upper segment, said upper segment having a neckline and a lower segment having an edge comprising a continuous covered bodice elastic waistband;

a trousers entity having a front-side, a back-side and an upper trouser segment having an upper edge comprising a continuous covered trouser elastic waistband;

a bar tack fastener element securing in overlapping contiguous relationship, at least at one location, said continuous covered bodice elastic waistband of said front-side of said bodice, to said continuous covered elastic waistband of said front-side of said trousers, thus forming a garment comprising said bodice entity fastened to said trousers entity;

said bodice entity having a predetermined size configured to fit a wearer and containing from between 23% to 33% additional material added to a length of said bodice entity material measured from said neckline to said continuous covered bodice elastic waistband so that, around said continuous covered bodice elastic waistband, there is a blouson effect resulting from of said additional material; and said continuous covered bodice elastic waistband of said bodice and said continuous covered elastic waistband of said trousers being configured to be simultaneously lowered to fully downwardly extend said material comprising said bodice, said covered elastic waistband of said bodice, and said covered elastic waistband of said trousers and said trousers, a distance below a waistline of a wearer, by the length of said additional material;

said additional material of said bodice being fully extended, said covered elastic waistband on said back-side of said trousers being configured to be further lowered substantially to rear mid-thigh to expose buttocks of said wearer.

2. The garment defined in claim 1 wherein said bodice has sleeves.

3. The garment defined in claim 2 wherein said bar tack fastener element securing in overlapping contiguous relationship, said covered elastic band of said front-side of said bodice, to said covered elastic pants waistband of said front-side of said trousers is comprises two bar tacks.

4. The garment defined in claim 3, wherein said bar tacks are located horizontally adjacent to each other and are configured to be substantially away from the center of and toward each hip of said wearer.

5. The garment defined in claim 4 wherein said trousers are selected from the group consisting of long pants and short pants.

6. The garment defined in claim 5 wherein an upper segment of said back-side of said of said bodice has a neck opening and has an element extending downwardly from said neck opening a distance sufficient to enable the wearer to don said bodice of said garment.

7. The garment defined in claim 6 wherein said closure element is selected from the group consisting of zipper and hook and loop fastener.

8. The garment defined in claim 5 wherein said garment comprising said material is made from a flexible elastic material.

9. The garment defined in claim 8 wherein said flexible elastic material is a stretch fabric.

10. The garment defined in claim 9 wherein said stretch fabric is selected from the group consisting of natural latex, synthetic latex, spandex, polyester.

11. The garment defined in claim 10 wherein said stretch fabric is spandex.

12. The garment defined in claim 1 wherein said back-side of said trousers has a first closure a element extending vertically downwardly from said upper edge of said trousers a distance sufficient to enable the wearer to don said garment and to more fully expose the buttocks.

13. The garment defined in claim 12 wherein an upper segment of said backside of said bodice has a neck opening and has a second closure element extending downwardly from said neck opening a distance sufficient to enable the wearer to don said bodice of said garment.

14. The garment defined in claim 12 wherein said closure element is selected from the group consisting of zipper and hook and loop fastener.

15. The garment defined in claim 14 wherein said closure element is a zipper.

16. The garment defined in claim 13 wherein said second closure element is a zipper.

17. The garment defined in claim 13 which is made from a material selected from the group consisting of jersey, rayon, polyester, nylon, cotton, crepe and denim, alone or a combination thereof.

18. The garment defined in claim 1 wherein bodice contains 24% additional material added to its length.

19. The garment defined in claim 1 wherein said trousers are selected from the group consisting of knee length pants or full length trousers.

* * * * *